US006519790B2

(12) United States Patent
Ko

(10) Patent No.: US 6,519,790 B2
(45) Date of Patent: Feb. 18, 2003

(54) OPTOELECTRONIC DEVICE ASSEMBLY MOUNTED TO BATHROOM EQUIPMENT

(75) Inventor: Hsi Chia Ko, Changhua Hsien (TW)

(73) Assignee: Chung Cheng Faucet Co., Ltd., Changhua Hsien (TW)

( * ) Notice: Subject to any disclaimer, the term of this patent is extended or adjusted under 35 U.S.C. 154(b) by 14 days.

(21) Appl. No.: 09/901,643

(22) Filed: Jul. 11, 2001

(65) Prior Publication Data

US 2003/0009823 A1 Jan. 16, 2003

(51) Int. Cl.[7] ..... F16K 37/00

(52) U.S. Cl. ..... 4/678; 4/661; 137/551; 340/603

(58) Field of Search ..... 4/605, 678; 137/551, 137/552; 340/603, 606; 257/690, 704, 784, 924

(56) References Cited

U.S. PATENT DOCUMENTS 2,561,763 A * 7/1951 Waters et al. ..... 340/606 X
5,160,197 A * 11/1992 Klose ..... 4/605 X
5,482,078 A * 1/1996 Yeh ..... 4/661 X
5,535,779 A * 7/1996 Huang ..... 137/551 X

* cited by examiner

*Primary Examiner*—Robert M. Fetsuga

(57) ABSTRACT

An optoelectronic device assembly mounted to bathroom equipment is mainly made up of a silicon chip, a face board in match with the silicon chip, a water proof seal plate in combination with a piece of bathroom equipment, such as a faucet, a shower head, a sink platform and a flush tank and bath tub that can be in direct contact with water. The silicon chip of a proper size and thickness is designed in conformance to the dimension and shape of a staged receiving hole of the bathroom equipment and is provided with an extended probe needle or a limiting switch which can be actuated by flow water in bathroom equipment whereby the brightness, colors of source light or sound produced by the silicon chip can be varied in response to the variation of water flow and the temperature thereof either for a change or warning purpose.

4 Claims, 6 Drawing Sheets

OPTOELECTRONIC DEVICE ASSEMBLY MOUNTED TO BATHROOM EQUIPMENT

BACKGROUND OF THE INVENTION

The present invention relates to an optoelectronic device assembly mounted to bathroom equipment. It is mainly made up of a silicon chip, a face board in match with the silicon chip, a water proof seal plate in combination with a piece of bathroom equipment, such as a faucet, a shower head, a sink, a flush tank and bath tub and devices of the like that can be in direct contact with water. The silicon chip of a proper size and thickness is designed in conformance to the dimension and shape of a staged receiving hole of the bathroom equipment and is provided with an extended probe needle or a limiting switch which can be actuated by a water flow in bathroom equipment whereby the brightness level, colors of source light or sound produced by the silicon chip can be varied in response to the variation of water flow and the temperature thereof either for a change or warning purpose.

Generally, the conventional bathroom devices are designed for a single purpose and is usually operated in a monotonous manner, and similar bathroom devices have nearly identical functions. For instance, the handle of a faucet is only actuated to control the flow of water and the faucet embodiment only allows water to flow therethrough; and other bathroom devices are also designed and operate in the same manner without any other features.

SUMMARY OF THE INVENTION

Therefore, the primary object of the present invention is to provide an optoelectronic device assembly mounted to bathroom equipment, such as a faucet, shower head, sink, flush tank and bath tub whereby various colors and brightness level of a light source and sound can be variably produced by way of a silicon chip in response to variations of the speed, volume and temperature of a water flow in the bathroom equipment.

Another object of the present invention is to provide an optoelectronic device assembly mounted to bathroom equipment, which can produce audio and visual effects for eye appealing and warning purpose as a result of variations of speed, volume and temperature of a water flow in bathroom equipment.

DETAILED DESCRIPTION OF THE PREFERRED EMBODIMENT

The detailed structure and the functional features of the present invention are illustrated by way of two embodiments.

Figure 1:
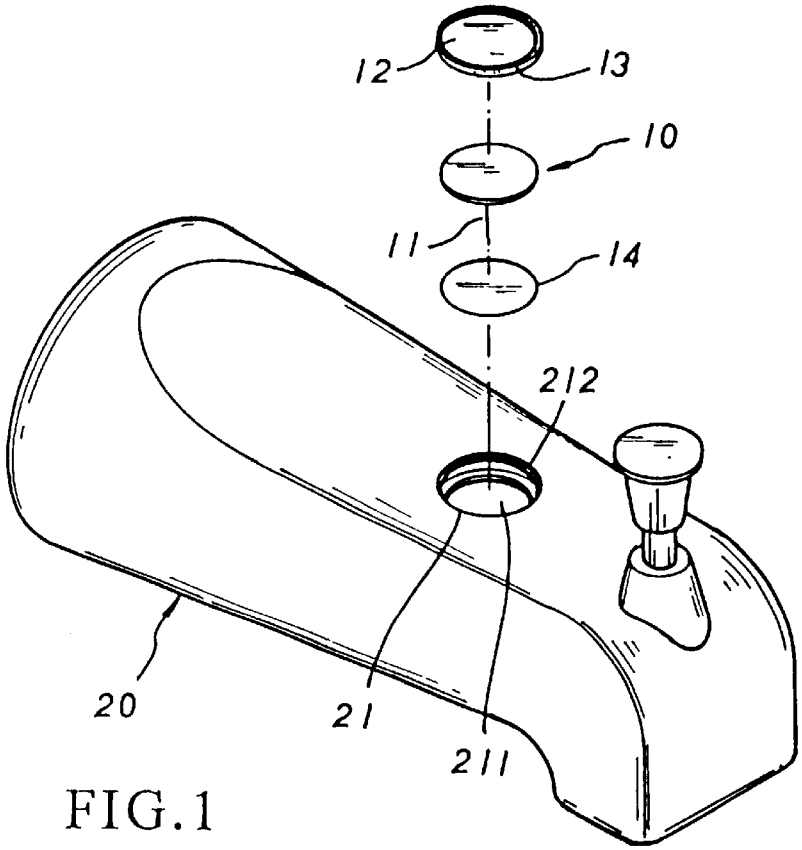
FIG. 1 is a perspective diagram showing the exploded components of the present invention.

Referring to FIG. 1, the exploded components of the first embodiment are shown in details wherein an optoelectronic device assembly mounted to bathroom equipment is mainly made up of a silicon chip 10, a face board 12 in match with the silicon chip 10, a water proof seal plate 14 in combination with a piece of bathroom equipment 20 having a receiving hole 21 disposed thereon at a proper position, such as a faucet, a shower head, a sink and a flush tank and devices of the like that can be in direct contact with water.

The silicon chip 10 of a proper size and thickness is designed in conformance to the dimension and shape of a receiving hole 21 of the bathroom equipment 20 and is provided with an extended probe needle 11 which can be actuated by a water flow in bathroom equipment.

The shape of the face board 12 conforms to the receiving hole 21 too and is provided with a seal ring 13 around the periphery thereof. The seal ring 13 has a peripheral recess 131 that can be in fit engagement with the boundary of the face board 12. The water proof plate 14 of proper thickness matches in shape with the receiving hole 21 of the bathroom equipment 20.

The receiving hole 21 disposed on the bathroom equipment 20 is in communication with the flow passage 22 of the bathroom equipment 20. The receiving hole 21 located at a front and direct position to be easily viewed is provided with a ring of peripheral flange 212 and has a staged through hole 211.

Figure 2:
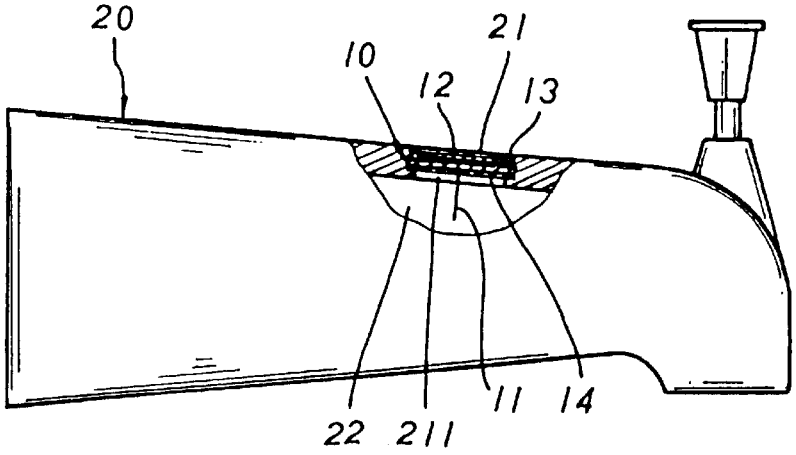
FIG. 2 is a partially sectional diagram of the assembly of the first embodiment of the present invention.
Figure 3:
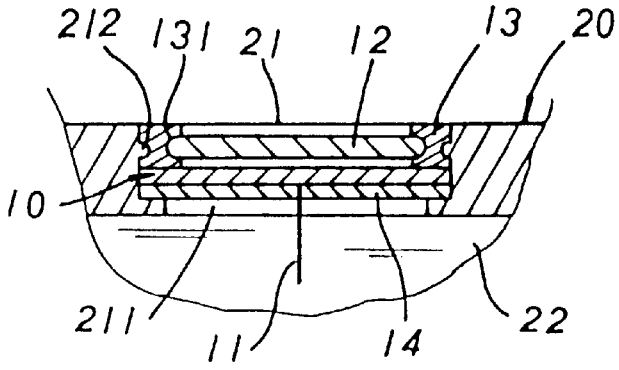
FIG. 3 is a partially enlarged diagram of FIG. 2.

In assembly, as shown in FIG. 2 and FIG. 3, the water proof seal plate 14 is first put in the interior of the staged through hole 211 of the bathroom equipment 20 and then the silicon chip 10 is placed on top of the water proof seal plate 14 with the probe needle 11 piercing through the water proof seal plate 14 and located in the flow passage 22 of the bathroom equipment 20. At last, the face board 12 is secured to the top opening of the receiving hole 21 with the seal ring 13 engaged with the peripheral flange 212 of the receiving hole 21 to complete the assembly.

Figure 4:
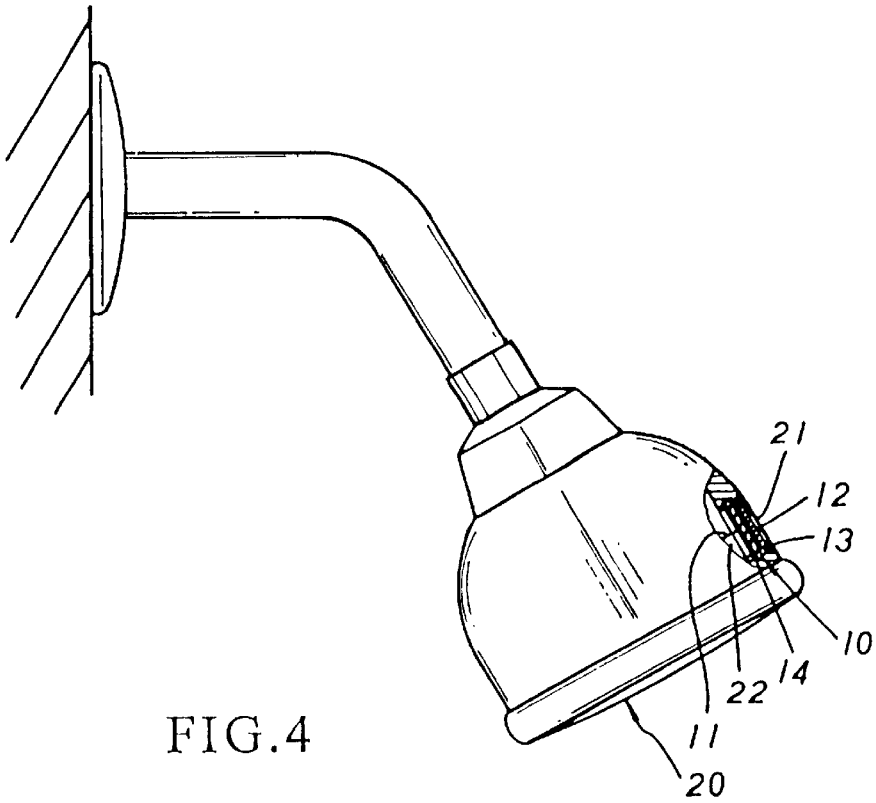
FIG. 4 is sectional diagram showing another application of the first embodiment of the present invention.

Moreover, the present invention can be also applied to other kind of bathroom equipment of an identical feature, such as a shower head instead of a faucet, as shown in FIG. 4.

Figure 5:
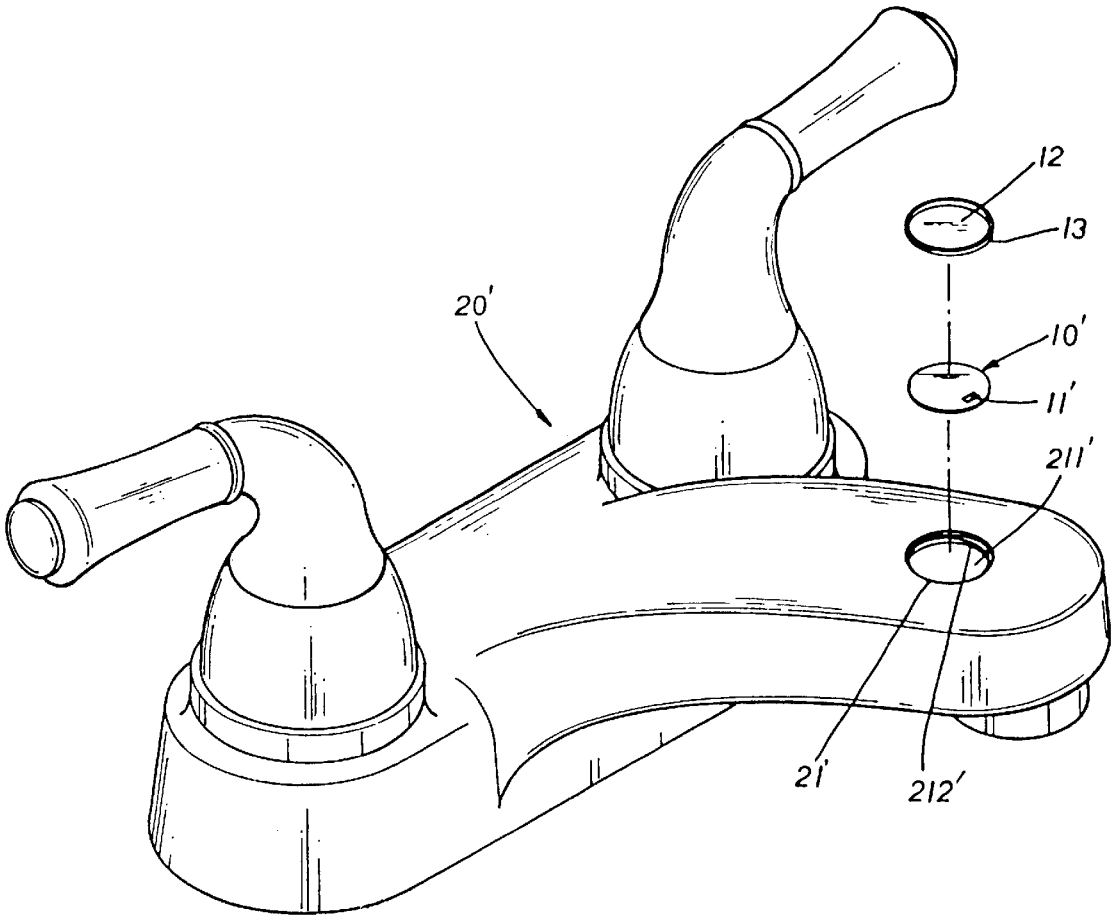
FIG. 5 is a perspective diagram showing the exploded components of the second embodiment of the present invention.

Referring to FIG. 5, the second embodiment of the present invention is illustrated. It mainly includes an optoelectronic silicon chip 10', a face board 12 in conformance to the silicon chip 10' in combination with a piece of bathroom equipment 20', locating at a place in no contact with a water flow, such as a faucet's handle and the like. The silicon chip 10' of a proper size and thickness and designed to conform to the shape and dimension of the receiving hole 21' on the bathroom equipment 20' is provided with a limiting switch 11' on one side thereof The face board 12 matching in shape with the receiving hole 21' of the bathroom equipment is provided with a seal ring 13 having a peripheral recess 131 engaged with the edge of the face board 12.

On the bathroom equipment 20' is located the receiving hole 21' at an apparent, direct and front position thereof for housing the silicon chip 10'. Such a receiving hole 21' has a cavity 211' and a peripheral flange 212' at the top opening thereof.

Figure 7:
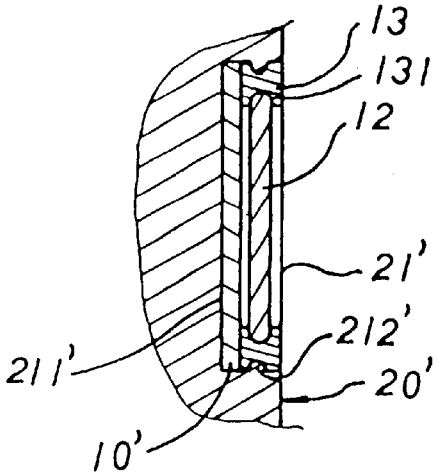
FIG. 7 is a partially enlarged diagram of FIG. 6.
Figure 6:
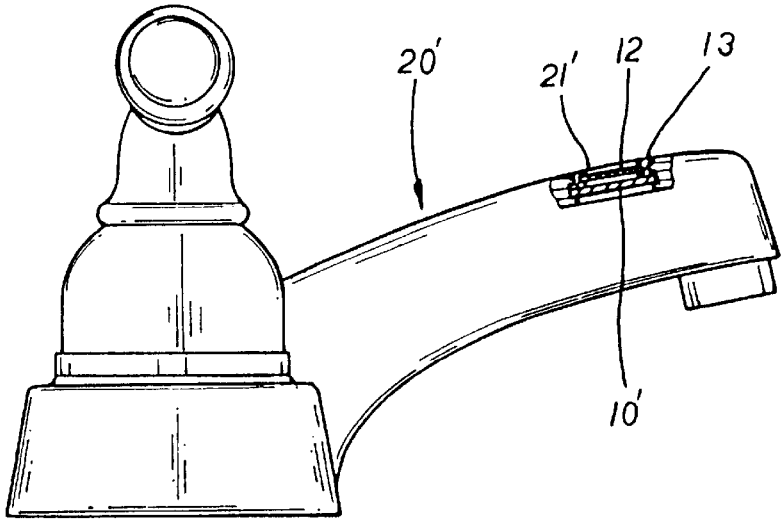
FIG. 6 is a sectional diagram showing the assembly of the second embodiment thereof.

In assembly, as shown in FIG. 6 and FIG. 7, the second embodiment of the present invention is applied to two different cases. The silicon chip 10' is placed at the bottom of the cavity 211' of the receiving hole 21' of the bathroom equipment 20' and then the opening of the receiving hole 21' is covered by the face board 12 whose peripheral flange 212' engaged with the seal ring 13 to complete the assembly.

Figure 8:
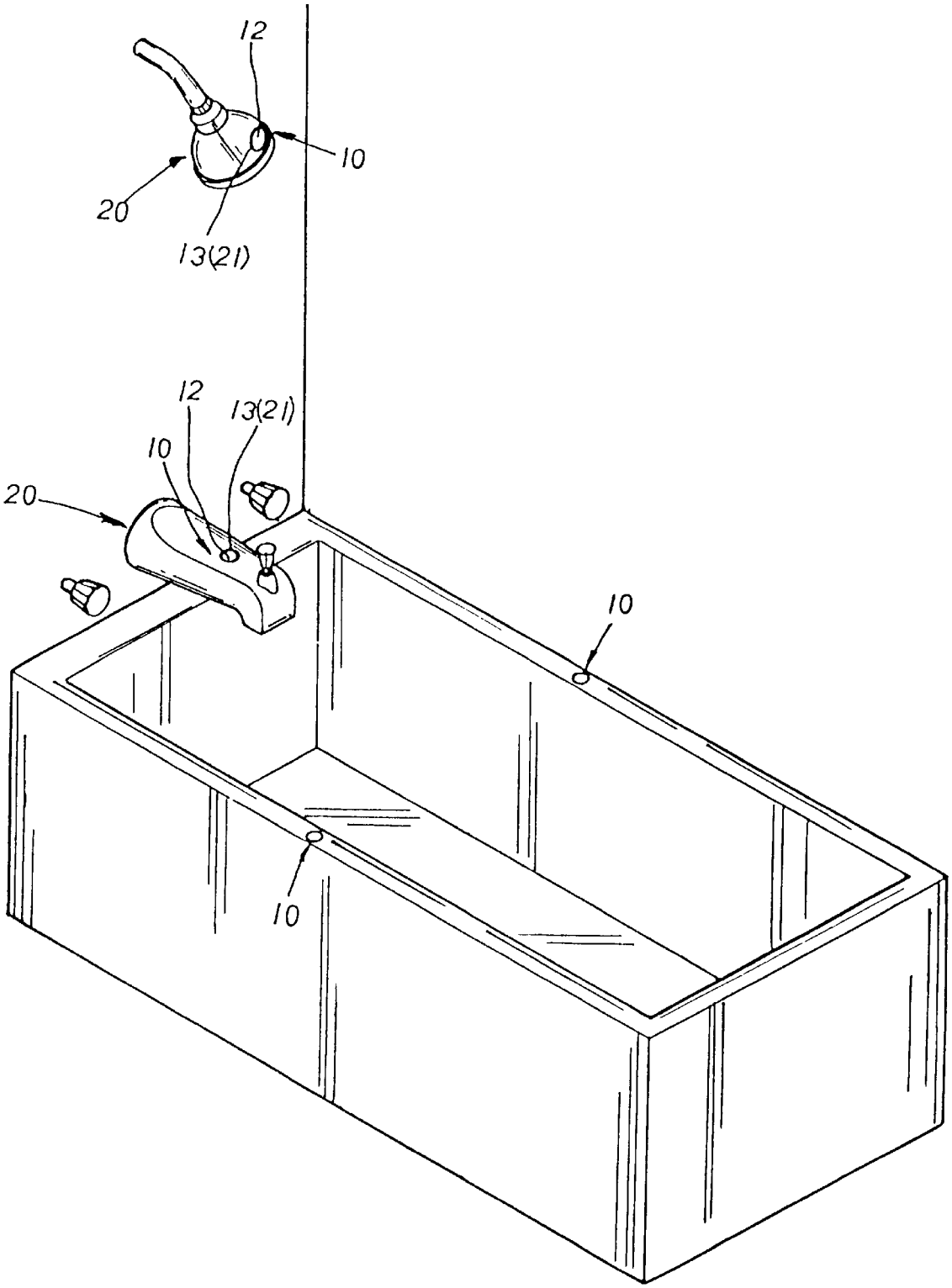
FIG. 8 is a perspective diagram showing the combination of the operation modes illustrated in FIG. 1 and FIG. 4.

In assembly, as shown in FIG. 8, the present invention is applied to both bathroom equipment including a shower head and a faucet as shown in FIG. 1 and FIG. 4 that are mounted in combination with a bath tub which also has silicon chips 10 attached to the sides thereof whereby as the variations of water flow, the silicon chips 10 can detect and respond in different light brightness level, colors, sound.

Figure 9:
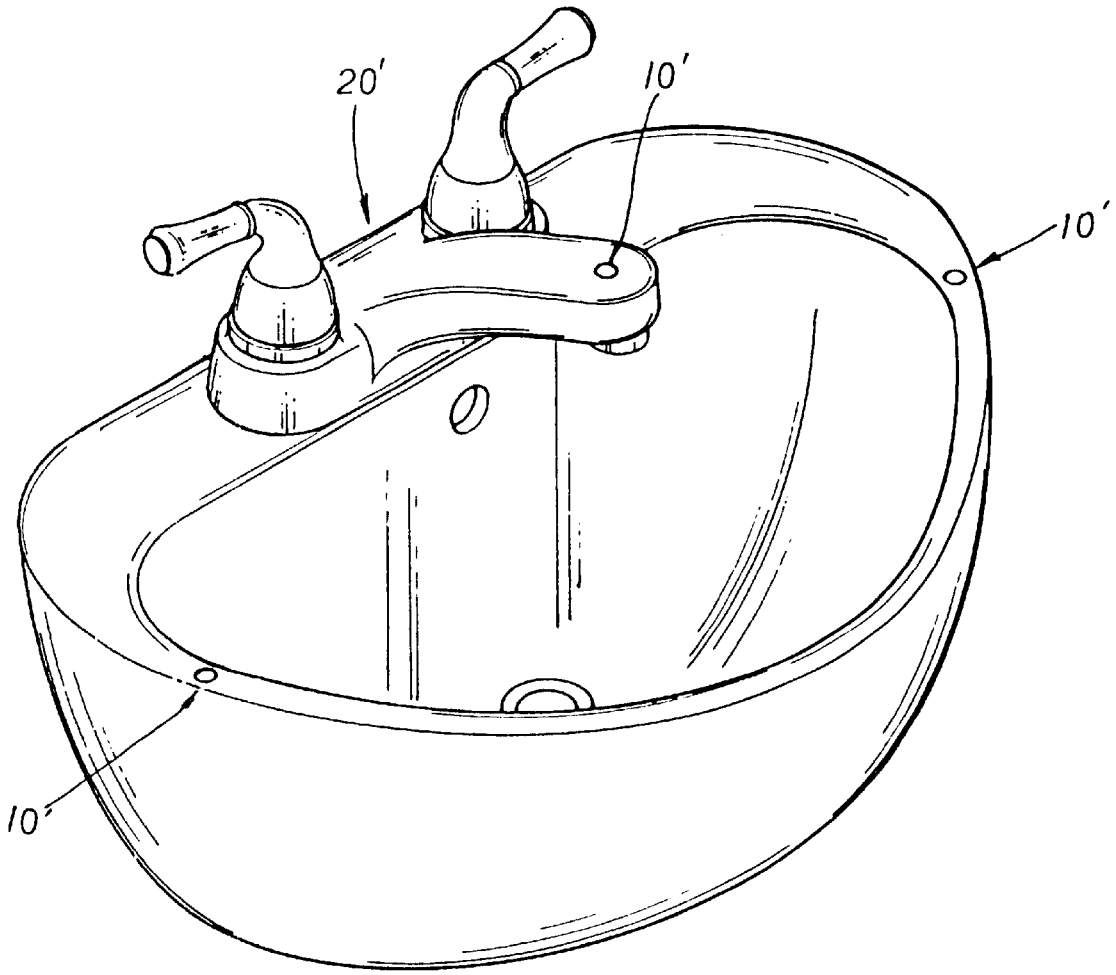
FIG. 9 is a perspective diagram showing the operation mode of the second embodiment illustrated in FIG. 5.

Moreover, as shown in FIG. 9, the silicon chips 10' of the present invention are applied to a piece of bathroom equipment 20' such as a sink. In such as manner, as a person washes hands, face, water flows in the bathroom equipment 20' such as a faucet and sink can be detected by the silicon chips 10' to respond in various light, colors and sound.

It becomes apparent that there are a number of advantages found in the present invention given as follows:

1. The silicon chips 10, 10' of bathroom equipment 20, 20' including a faucet, shower head, sink, flush tank and bath tub are mounted to the same can produce brightness level, colors, sound changes on silicon chips as a result of variations in a water flow detected by silicon chips.
2. The silicon chips 10, 10' of bathroom equipment 20, 20' can be randomly mounted to faucets, shower heads, sinks, flush tanks and bath tubs so as to produce visual and audio effects individually or in combination in response to variations of a water flow in bathroom equipment.

I claim:

1. A water faucet assembly comprising:

a) a water faucet having a flow passage therein and a receiving hole extending through an outer surface of the water faucet in communication with the flow passage, the water faucet including a first flange extending into the receiving hole adjacent to the outer surface and a second flange extending into the receiving hole adjacent to the flow passage;

b) a waterproof seal plate located in the receiving hole on the second flange;

c) a face board located in the receiving hole, the face board having an outer edge;

d) a seal ring having an annular configuration with an inner groove engaging the outer edge of the face board, and an outer groove engaged with the first flange to attach the face board to the water faucet; and, e) a silicon chip located in the receiving hole between the face board and the waterproof seal plate, the silicon chip producing a signal upon a predetermined condition of water in the flow passage.

2. The water faucet assembly of claim 1 further comprising a probe needle extending from the silicon chip, through the waterproof seal plate and into the flow passage.

3. The water faucet assembly of claim 1 wherein the signal produced by the silicon chip is an audible signal.

4. The water faucet assembly of claim 1 wherein the signal produced by the silicon chip is a visual signal.

* * * * *